US007157674B2

(12) United States Patent
Miyauchi et al.

(10) Patent No.: US 7,157,674 B2
(45) Date of Patent: Jan. 2, 2007

(54) INDUCTION HEATER WITH CONTROLLED CURRENT TO HEATING COIL

(75) Inventors: Takahiro Miyauchi, Kobe (JP); Koji Niiyama, Kobe (JP); Yuji Fujii, Kobe (JP); Atsushi Fujita, Mino (JP); Izuo Hirota, Toyonaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 3 days.

(21) Appl. No.: 10/531,893

(22) PCT Filed: Nov. 18, 2003

(86) PCT No.: PCT/JP03/14631

§ 371 (c)(1),
(2), (4) Date: Apr. 20, 2005

(87) PCT Pub. No.: WO2004/047497

PCT Pub. Date: Jun. 3, 2004

(65) Prior Publication Data

US 2006/0157478 A1 Jul. 20, 2006

(30) Foreign Application Priority Data

Nov. 20, 2002 (JP) ..... 2002-336452

(51) Int. Cl.
*H05B 6/08* (2006.01)
*H05B 6/12* (2006.01)
*A47J 27/00* (2006.01)

(52) U.S. Cl. ..... 219/621; 219/626; 219/665; 219/518; 219/668; 99/451

(58) Field of Classification Search ..... 219/620–627, 219/663–668, 518; 99/451, 325
See application file for complete search history.

(56) References Cited

U.S. PATENT DOCUMENTS

2004/0188426 A1* 9/2004 Hirota et al. ..... 219/663

FOREIGN PATENT DOCUMENTS

| | | |
|---|---|---|
| JP | 07-282967 A | 10/1995 |
| JP | 2001-332375 A | 11/2001 |
| JP | 2002-299024 A | 10/2002 |

OTHER PUBLICATIONS

International Search Report for PCT/JP03/14631, dated Mar. 2, 2004.

* cited by examiner

*Primary Examiner*—Philip H. Leung
(74) *Attorney, Agent, or Firm*—RatnerPrestia

(57) ABSTRACT

A detector is operable to detect a displacement of a load by an ascending force based on a period of time from a time a heating output of an inverter drops from a predetermined level to a first level, to a time the heating output returns back to a second level larger than first level. Thereby, the detector distinguishes an intentional removal of the load from the displacement of the load by the ascending force. An induction heater including the detector reduces the displacement of the load by the ascending force and stops the heating of the load when the load is removed intentionally.

17 Claims, 4 Drawing Sheets

INDUCTION HEATER WITH CONTROLLED CURRENT TO HEATING COIL

This application is U.S. National phase Application of PCT International Application PCT/JP2003/014631.

FIELD OF THE INVENTION

The present invention relates to an induction heater for inductively heating a load composed substantially of metallic material.

BACKGROUND OF THE INVENTION

When a load having a light weight, such as a pot or pan made of non-magnetic metallic material having a small resistance, such as aluminum is heated inductively by a high-frequency magnetic field for heating and cooking an object contained in the load, the load receives an ascending force generated by eddy currents induced by the magnetic field over a heating coil. This force may lift up the load or displace the load laterally during the cooking.

Japanese Patent Laid-Open Publication No. 2001-332375 discloses a conventional induction heater. In the conventional heater, while an output for heating gradually increases from a small level at the starting of the heating to a predetermined level, a change of a source current is monitored to find the lifting and displacement of a load. If the displacement of the load is found, the conventional induction heater performs a control, such as stopping its heating action or decreasing its input power.

FIG. 4 is a schematic view of the conventional induction heater. An inverter 101 drives a switching element included therein to allow a heating coil 102 to generate a high-frequency magnetic field of 50 to 100 kHz as to inductively heat a load 103 made of aluminum. An heating output is changed by controlling a frequency of the driving the switching element.

FIGS. 5A and 5B illustrate a change with time of a power consumed for the inductive heating of the load 103 with the heating coil 102 after the starting of the heating (an input power to the heating coil 102) and a change with time of the source current input to the inverter 101, respectively. According to an increase of the input power to the heating coil 102, i.e., a heating output of the inverter 101, the source current increases. According to the increase of the source current, the ascending force generated by the magnetic field from the heating coil 102 increases, accordingly lifting up the load or moving the load laterally at time P0. Thus, the load departs from the heating coil 102, and the power input to the heating coil 102 accordingly decreases after the time P0. Thus, the gradient of the increase with time of the power input to the heating coil 102 or the source current becomes smaller than that before the time P0.

The value of the source current (peat value or effective value) is measured by a detecting circuit 104. Upon the detecting circuit 104 detecting a change with time of the source current, the inverter 101 stops the heating of the load or reduces the input power, thereby preventing the lifting or displacement of the load.

The conventional induction heater can detect the lifting or displacement of the load at the start of the heating. In other words, the load is not displaced at the start of the heating, thus being heated. The weight of the load may decrease after a long period of time after the start, for example, after water in the load is evaporated or food contained in the load. In this case, the conventional induction heater may fail to detect the change of the weight and continue to heat the load, thereby lifting the load or displacing the load.

SUMMARY OF THE INVENTION

An induction heater is operable to inductively heat a load made of non-magnetic, metallic material having a small resistance. The induction heater includes a heating coil operable to inductively heat the load with a magnetic field, a high-frequency power source supplying a high-frequency current to the heating coil, a heating output detector for detecting a heating output of the heating coil, a first detector operable to measure a period of time from a time the heating output drops to a first level smaller than a predetermined level, to a time the heating output increases to a second level, and, a controller operable to control the high-frequency power source according to the heating output detected by the first detector so that the heating output becomes the predetermined level. The controller is operable to control the high-frequency power source by detecting, based on the measured period, a displacement of the load due to the magnetic field.

The induction heater detects detecting lifting or displacement of the load by an ascending force, thereby stopping or reducing a heating output. The lead, even being made of non-magnetic, metallic material having a small resistance, such as aluminum or copper, can be inductively heated by the induction heater while being prevented from lifting or displacement.

DESCRIPTION OF THE PREFERRED EMBODIMENT

Figure 1:
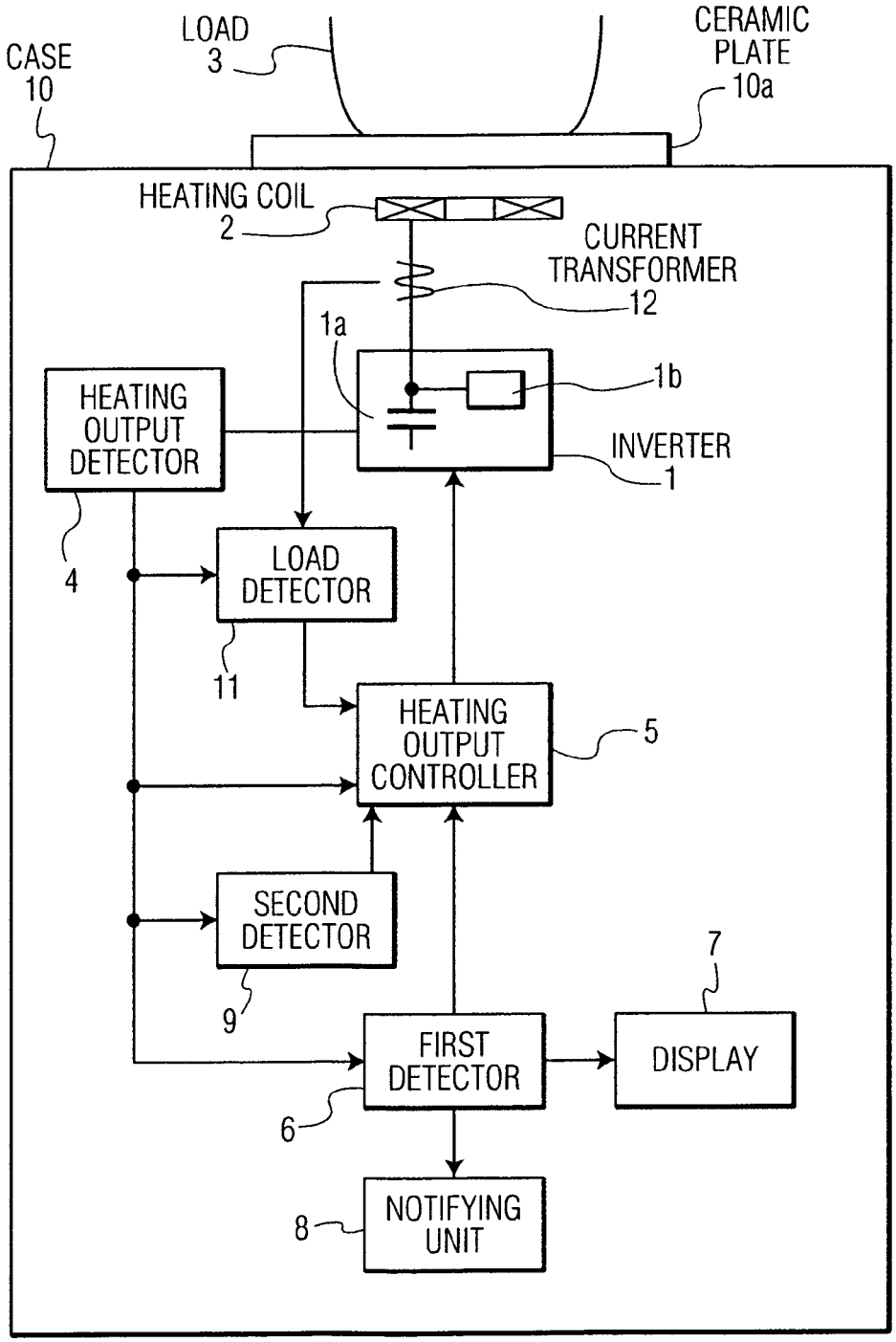
FIG. 1 is a schematic view of an induction heater according to an exemplary embodiment of the present invention.

FIG. 1 is a schematic view of an induction heater according to an exemplary embodiment of the present invention. A case 10 includes a ceramic plate 10*a* provided at a top thereof. A load 3 is placed on the ceramic plate 10*a*. An inverter 1 is accommodated in the case 10. A heating coil 2 is located beneath the ceramic plate 10*a*. The inverter 1, a high frequency power source, converts a direct current input thereto into a high frequency souse and supplies a high frequency output of 50 to 100 kHz to the heating coil 2. The inverter 1 is connected to a commercial power source (not shown) of a available frequency. The high-frequency source may be a simple converter for converting a commercial alternate current input of a low frequency into a high frequency output without rectifying the alternate current.

Figure 4:
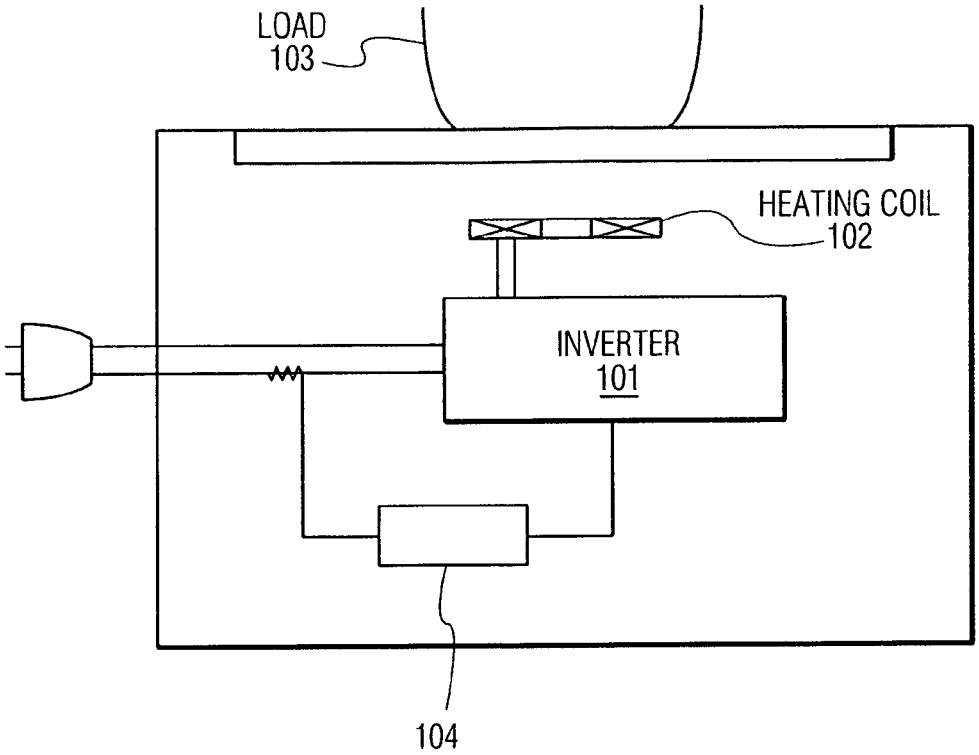
FIG. 4 PRIOR ART
FIG. 4 is a schematic view of a conventional induction heater.

A heating output detector 4 measures a heating output from the inverter 1, i.e., a power consumed by the heating coil 2 and the load 3. According to this embodiment, the heating output detector 4, similarly to detecting circuit 104 shown in FIG. 4, measures the input current received from the commercial power source in order to indirectly detect the heating output of the inverter 1 and outputs a signal accordingly. A heating output controller 5, in responsive to the signal from the heating output detector 4, controls on/off operation of a switching element of the inverter 1 to determine the heating output of the inverter 1, so that the output of the inverter 1 becomes a predetermined level, or the voltage or current applied to components of the inverter 1 does not exceed a predetermined level in order to protect of components of the induction heater.

A first detector 6, in responsive to a detection signal from the heating output detector 4, examines the situation of the load after the heating output of the inverter 1 becomes stable. More particularly, the first detector 6 examines whether or not the load on the ceramic plate 10*a* above the heating coil 2 is lifted and displaced by an ascending force, and outputs a signal to the heating output controller 5, a display 7, and a notifying unit 8. A second detector 9, in responsive to a signal output from the heating output detector 4, examines the situation of the load before the heating output becomes stable after the starting of the inverter 1. More particularly, the second detector 9 examines whether or not the load on the ceramic plate 10*a* above the heating coil 2 is lifted and displaced by an ascending force, and accordingly, outputs a signal to the heating output controller 5.

A load detector 11 compares a current in the heating coil 2 measured by a current transformer 12 with a current input to the inverter 1 measured by the heating output detector 4. If the current in the heating coil 2 is greater than the current input to the inverter 1, the load detector 11 judges that the load 3 does not exist at a heating position (i.e., there is no load), or that a small load (such as a knife or fork) exists at the heating position. The load detector 11 instructs the controller 5 to stop the heating, and after a predetermined period of time (for example, two seconds), starts the detecting of the small load again.

An operation of the induction heater according to the embodiment heating a load 3 made of material having a small resistance and a small magnetic permeable coefficient, such as aluminum or copper will be described (the resistance of aluminum is $2.75\times10^{-8}\Omega\cdot m$). In order to generate a joule energy by inductively heating the load 3 of such non-magnetic material having a small resistance and a small permeable coefficient, a large current is supplied to each of the load 3 and the heating coil 2. A magnetic field generated by the heating coil 2 and an eddy current induced to the load 3 act on each other and produce an ascending force acting on the load 3 accordingly, thereby often lifting or displacing the load. According to this embodiment, the material having the small resistance and the small magnetic permeable coefficient is material possibly causing the load 3 to be lifted or displaced by the magnetic filed generated by the heating coil 2 when the load 3 is heated. When the induction heater of the embodiment is turned on by a user inputting a heating command through an operation unit (not shown) of the heater, heating output controller 5, similarly to the conventional induction heater shown in FIGS. 4, 5A, and 5B, gradually increases the heating output of the inverter 1 from a small level to a predetermined level while monitoring the detection signal output from the heating output detector 4.

Figure 5A:
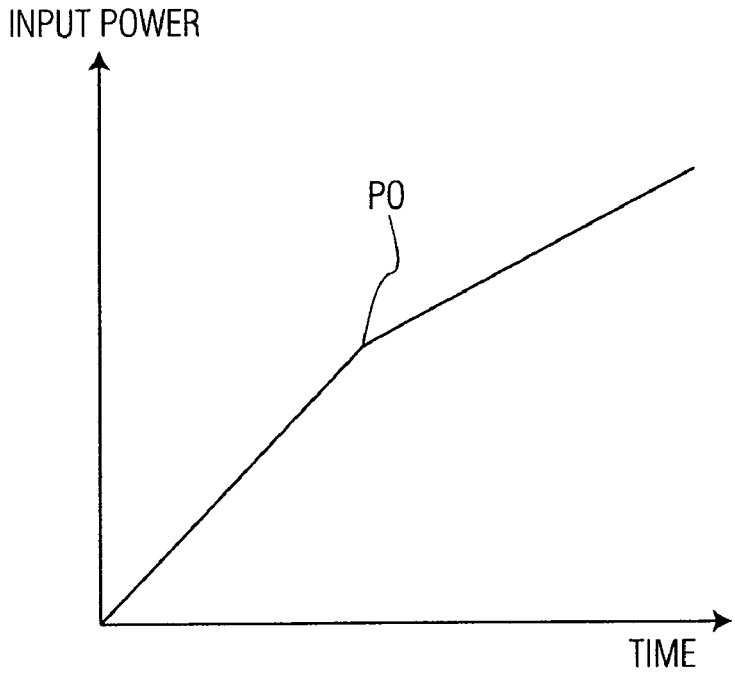
FIG. 5A PRIOR ART
FIG. 5A shows characteristics of the conventional induction heater.
Figure 5B:
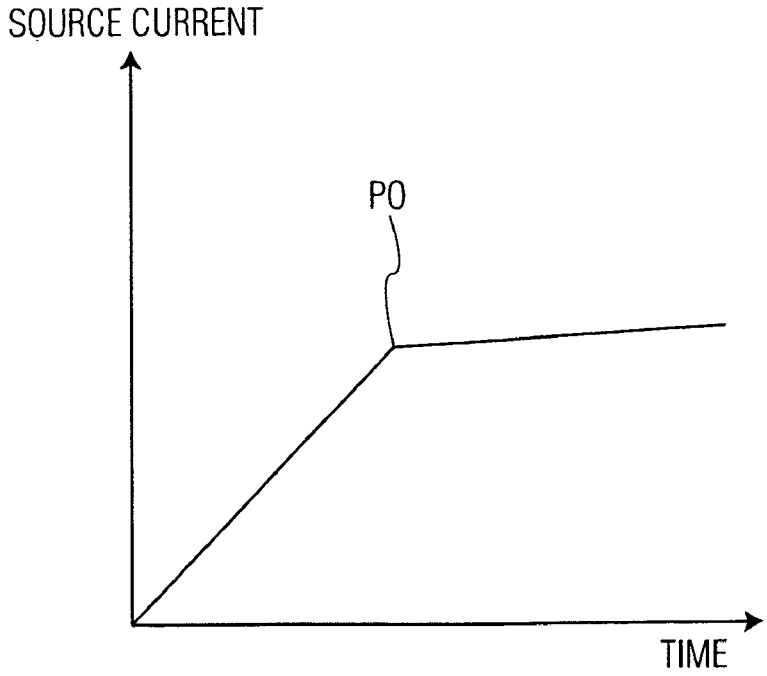
FIG. 5B PRIOR ART
FIG. 5B shows characteristics of the conventional induction heater.

When detecting a change of an increase with time of the current input to the inverter 1, as shown in FIG. 5B, the second detector 9 judges that the load 3 is lifted or displaced by the magnetic field generated by the heating coil 2 and the currents induced in the load 3 by the magnetic field.

The load 3 filled with a large amount of water is heavy and is not lifted or displaced even when the heating output of the inverter 1 increases to a predetermined level. Therefore, the load 3 is heated continuously at the predetermined level. Then, the water in the load 3 is partially evaporated and has an amount decrease, the ascending force acting on the load 3 accordingly becomes greater than a total weight of the load 3 and the water, thus lifting the load 3. In this case, the second detector 9 detects the lifting of the load 3 and measures the heating output at the time of the detection or before or after a predetermined period of time from the detection so as to set the heating output to a level smaller than the previous output.

As described in above, the induction heater of the embodiment can heat the load 3 while not causing the load to be lifted at the start or during a stable output regardless of a predetermined level of the heating output, The heater decreases the heating output to a level smaller than the predetermined level if the load 3 is possibly lifted or displaced by the predetermined level of the heating output.

Upon detecting that the load 3 is lifted or displaced, the second detector 9 may indicate the lifting visually on the display 7 and/or audibly through a notifying unit 8.

Figure 2:
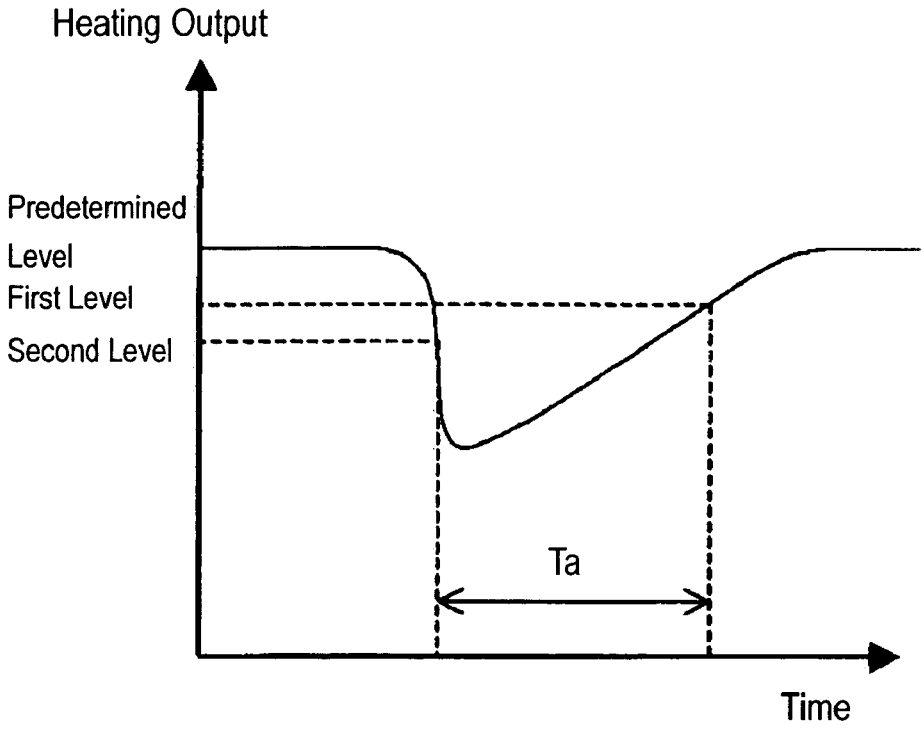
FIG. 2 illustrates a waveform of an output of a heating output detector of the induction heater according to the embodiment.

FIG. 2 illustrates a waveform of an output of the heating output detector 4 of the induction heater of the embodiment. The first detector 6 measures the output of the heating output detector 4 not at the starting but while the output of the inverter 1 detected by the heating output detector 4 is stable at a predetermined level. When the load 3 is lifted and increases the distance between the heating coil 2 and the load 3, a magnetic coupling between them accordingly decreases, and a power consumption of the load 3 decreases. This makes the heating output of the inverter 1 smaller than the predetermined level at its stable condition, and accordingly, reduces the source current, and then, a detection voltage from the heating output detector 4 becomes smaller than a level corresponding to the output of the inverter 1. The load 3 is not usually fixed. If being lifted, the load 3 is laterally displaced on and along the plate 10*a*, and the position of the load 3 becomes stable if a distribution of the weight of the load and a distribution of the ascending force are stable. After the position of the load 3 becomes stable, the distance from the heating coil 2 to the load becomes smaller that the distance between them at the time the load is lifted. This causes the heating output measured by the heating output detector 4 to increase up to the predetermined level at the stable condition. The first detector 6 then measures a period Ta of time (a small-output period) during which the output of the inverter 1 measured by the heating output detector 4 returns from a first level smaller than the predetermined level back to a second level larger than the first level. When the period Ta exceeds a predetermined period of time (for example, two seconds), the first detector 6 judges that the load 3 is lifted or displaced due to the ascending force, and outputs a detection signal to the heating output controller 5. The second level is smaller than the predetermined level.

Upon receiving the detection signal from the first detector 6, the heating output controller 5 stops the inverter 1 to stop the heating of the load 3 by the heating coil 2. Then, the heating output controller 5 restarts the inverter 1 for gradually increasing its output from a minimum level. When the second detector 9 detects the time P0 at which the increase of the output changes as shown in FIG. 5A, i.e., at which the load 3 is lifted, the heating output detector 4 measures the output at the time P0. The heating output controller 5 sets the heating output of the inverter 1 to a level smaller than the output measured at the time P0. As a result, the inverter 1 can continuously heat the load 3 at the heating output as much as possible while allowing the load not to be lifted.

Figure 3:
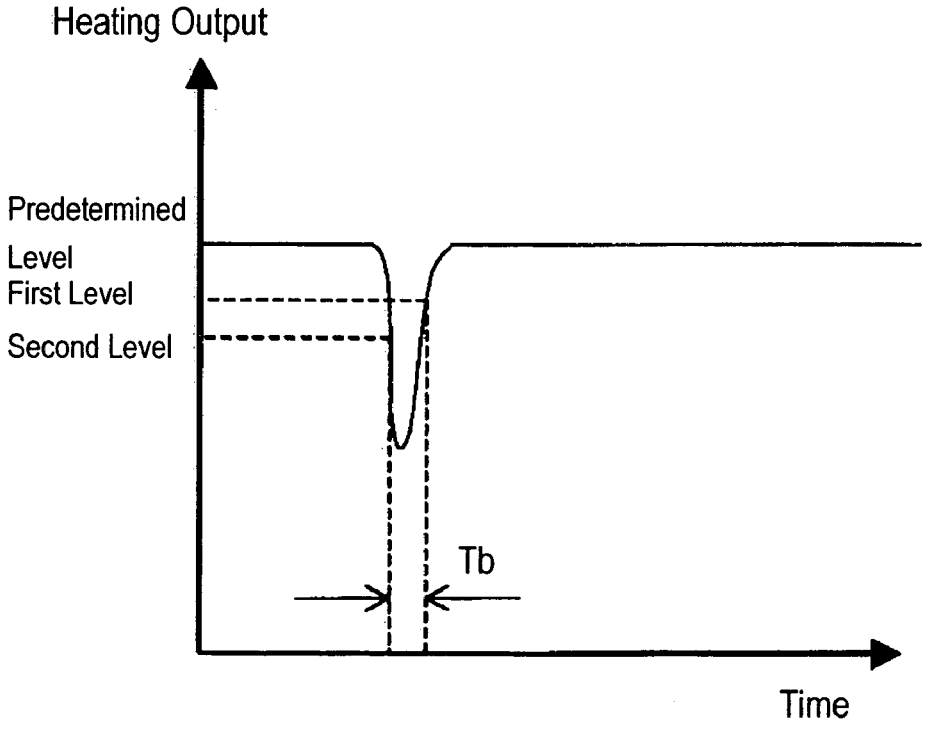
FIG. 3 illustrates a waveform of another output of the heating output detector of the induction heater according to the embodiment.

A user may lift up and down the load 3 during cooking. FIG. 3 illustrates a waveform of an output of the heating output detector 4 in such case. A period Tb of time (a small-output period) during which the output of the inverter 1 drops from a first level and returns back to an original level is generally 0.2 seconds to 0.5 seconds. Since the period Tb is shorter than the period Ta (2 sec.) during which the first detector 6 judges that the load 3 is lifted or displaced, the first detector 6 does not output a signal to the heating output controller 5. Consequently, the inverter 1 heats the load 3 continuously at the predetermined level of the output.

As described, the small-output period measured by the heating output detector 4 is short when the user intentionally lifts the load 3 up and down, and the small-output period is long when the load 3 is accidentally lifted or displaced. This difference allows the heating output controller 5 to discriminate the displacement of the load 3 by the ascending force from the intentional lifting by detecting the small-output period of the heating output of the inverter 1. The small-output period can be measured easily and accurately by the above mentioned method, but may be measure by a method for practically measuring the small-output period.

When detecting the lifting of the load 3, the first detector 6 instructs the display 7 to display an indication of the lifting and instructs the notifying unit 8 to audibly notify the user of the lifting. Thereby, the user acknowledges that the load 3 is lifted or displaced.

When the load 3 is intentionally removed off (no-load state), the load detector 11 detects the removal of the load 3 before the first detector 6 judges that the load 3 is lifted or displaced. Upon detecting the removal of the load 3, the load detector 11 instructs the controller 5 to stop the operation of the heating coil 3 and to decrease the heating output to a small level for allowing the load 3 not to be lifted or displaced. After two seconds, the controller 5 restarts the heating operation with a soft startup procedure. When the first detector 6 detects the lifting or displacement of the load 3 by the ascending force, the controller 5 stops the heating operation of the heating coil 3, and at 0.5 second after that, restarts the operation with a soft startup procedure. More specifically, the stopping period after the first detector 6 detects the displacement of the load 3 by the ascending force is set to be shorter than the stopping period after the load detector 11 detects the intentional removal of the load 3 by the user. This setting prevents the power (the heating output) input to the load 3 from decreasing while the load 3 is lifted or displaced, thereby improves cooking performance. Further, when the load detector 11 is activated, the power input to the load 3 may be reduced to suppress an increase of the temperature of the load when, for example, a small load (such as a knife or fork) is placed at the heating position above the heating coil 2.

According to this embodiment, the heating output of the inverter 1 is measured by the heating output detector 4 detecting a current input to the inverter 1 for measuring of, however, may be measured not by the method. The heating output detector 4 may measure the heating output of the inverter 1 from any of a power input to the inverter 1, a current flowing in the heating coil 2, a voltage across a resonant capacitor 1*a* of the inverter 1, or a voltage or current supplied to an inverter component 1*b* of the inverter 1 which correlate to the current in the heating coil 2.

According to this embodiment the first detector 6 judges that the load 3 is lifted or displaced when the period Ta is longer than a predetermined period. The first detector 6 may distinguish the intentional lifting up and down of the load 3 from the displacement of the load 3 by the ascending force by detecting the displacement of the load by the ascending force based on the period Ta, for example, through calculating the period Ta and relating the displacement to the heating output.

INDUSTRIAL APPLICABILITY

An induction heater according to the present invention detects the lifting or displacement of a load by an ascending force of the load, and stops or reduces a heating output. The induction heater can heat a load having a light weight made of non-magnetic, metallic material having a small resistance while preventing the load from being lifted or displaced. Even if the load is intentionally displaced, a heating output of the heater does not decrease or stop.

The invention claimed is:

1. An induction heater comprising:

a heating coil operable to inductively heat a load with a magnetic field, the load being made of non-magnetic, metallic material;

a high-frequency power source supplying a current to the heating coil;

a heating output detector for detecting a heating output of the heating coil;

a first detector operable to measure a period of time from a time the heating output drops to a first level smaller than a predetermined level, to a time the heating output increases to a second level; and a controller operable to signal the high-frequency power source to change output of said high-frequency power source if said period of time exceeds a predetermined amount of time.

2. The induction heater according to claim 1, wherein the controller is operable to reduce the heating output if said period of time exceeds the predetermined amount of time.

3. The induction heater according to claim 2, further comprising a load detector operable to, in a case that the load heated by the heating coil is removed, before the controller reduces the heating output when judging that the load is displaced, detects that a heating operation is performed while the load does not exists, and stops the heating output of the heating coil.

4. The induction heater according to claim 3, wherein the controller is operable to upon detecting that the load is displaced, reduce the heating output for a first period of time, and then, increase the heating output gradually, and upon detecting, from an output of the load detector, that the load is removed, decrease the heating output for a second period of time longer than the first period, and then, increase the heating output gradually.

5. The induction heater according to claim 2, wherein the controller is operable to stop the heating output upon judging that the load is displaced by an ascending force produced by the magnetic field.

6. The induction heater according to claim 1, wherein the controller is operable to judge that the load is displaced by an ascending force produced by the magnetic field if the measured period exceeds said predetermined period of time.

7. The induction heater according to claim 1, wherein the controller is operable to reduce decrease the heating output when the measured period exceeds said predetermined period of time.

8. The induction heater according to claim 7, wherein the controller is operable to stop the heating output when the measured period exceeds the predetermined period.

9. The induction heater according to claim 1, further comprising a display for, when the controller judges that the load is displaced by an ascending force produced by the magnetic field, displaying an indication of the displacing of the load visually.

10. The induction heater according to claim 1, further comprising a notifying unit for, when the controller judges that the load is displaced by an ascending force produced by the magnetic field, notifying the displacing of the load audibly.

11. The induction heater according to claim 1, further comprising a second detector for detecting a change of an increase with time of the detected heating output when the heating output increases, wherein the controller is operable to increase the heating output gradually, and reduce the heating output when the second detector detects the change of the increase with time.

12. The induction heater according to claim 11, wherein the controller is operable to decrease the heating output when detecting that the load is displaced by an ascending force produced by the magnetic field, and then increase the heating output gradually, and reduce the heating output according to the heating output at a time the second detector detects that the load is removed.

13. The induction heater according to claim 1, wherein the second level is equal to the predetermined level.

14. The induction heater according to claim 1, wherein the second level is smaller than the predetermined level.

15. The induction heater according to claim 14, wherein the second level is larger than the first level.

16. The induction heater according to claim 1, wherein the high-frequency power source comprises one of an inverter and a converter.

17. The induction heater according to claim 1, wherein the heating output detector detects the heating output by measuring at least one of a current input to the high-frequency power source, a power input to the high-frequency power source, a current flowing in the heating coil, and a voltage or a current of a component of the high-frequency power source.

* * * * *